US005420398A

United States Patent [19]

Petri et al.

[11] Patent Number: 5,420,398

[45] Date of Patent: May 30, 1995

[54] TEMPERATURE DETECTION DEVICE

[75] Inventors: Heinz Petri, Bretten; Siegfried Mannuss, Sternenfels, both of Germany

[73] Assignee: E.G.O. Elektro-Gerate Blanc u. Fischer, Oberderdingen, Germany

[21] Appl. No.: 982,212

[22] Filed: Nov. 25, 1992

[30] Foreign Application Priority Data

Nov. 26, 1991 [DE] Germany ..... 41 38 817.8

[51] Int. Cl.[6] ..... H05B 1/02

[52] U.S. Cl. ..... 219/505; 219/448; 219/451; 219/494; 337/354; 337/383

[58] Field of Search ..... 219/505, 443, 445, 447, 219/448, 450, 451, 494, 483, 486; 337/354, 383, 394, 396

[56] References Cited

U.S. PATENT DOCUMENTS 4,544,831 10/1985 Bayer .
4,633,238 12/1986 Goessler et al. .
5,046,156 9/1991 Hofsass .
5,113,170 5/1992 Goessler et al. .

FOREIGN PATENT DOCUMENTS 0394693 10/1990 European Pat. Off. .
0410119 1/1991 European Pat. Off. .
0416335 3/1991 European Pat. Off. .
2548825 1/1985 France .
2839161 3/1980 Germany .
3232511 4/1983 Germany .
3410442 9/1985 Germany .
3536981 4/1987 Germany .
3340414 5/1987 Germany .
3705260 9/1988 Germany .
3913289 10/1990 Germany .
3929965 3/1991 Germany .
4029351 3/1992 Germany .
2133879 8/1984 United Kingdom .
2164150 3/1986 United Kingdom .

*Primary Examiner*—Mark H. Paschall
*Attorney, Agent, or Firm*—Quarles & Brady

[57] ABSTRACT

A device (1*f*), which is e.g. provided as an overheating protection means for detecting the temperature on a heating device (4*f*), apart from a temperature sensor (3*f*), also has an insulating connecting piece (20*f*) with all the connecting elements (23*f*) necessary for the electrical connection of the heating device (4*f*), in such a way that these connecting elements (23*f*), following the fastening of the device (1*f*) to the heating device (4*f*), are accessible directly adjacent to the outer circumference thereof and to the associated face (31*f*) of a device base (19*f*), so as to produce the necessary connections.

30 Claims, 7 Drawing Sheets

Figure 6:
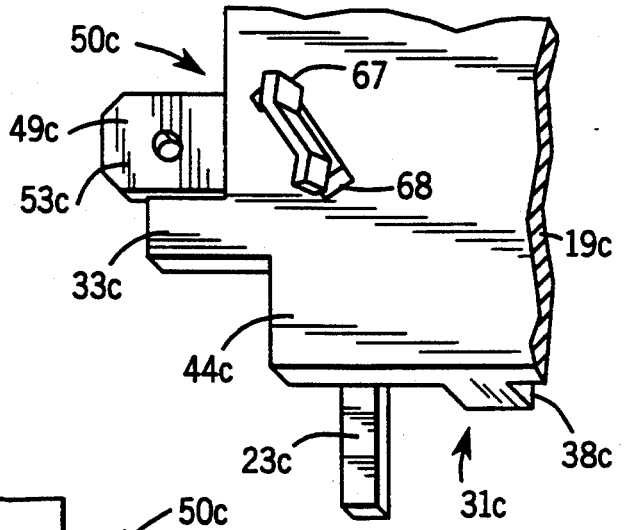

FIG. 1
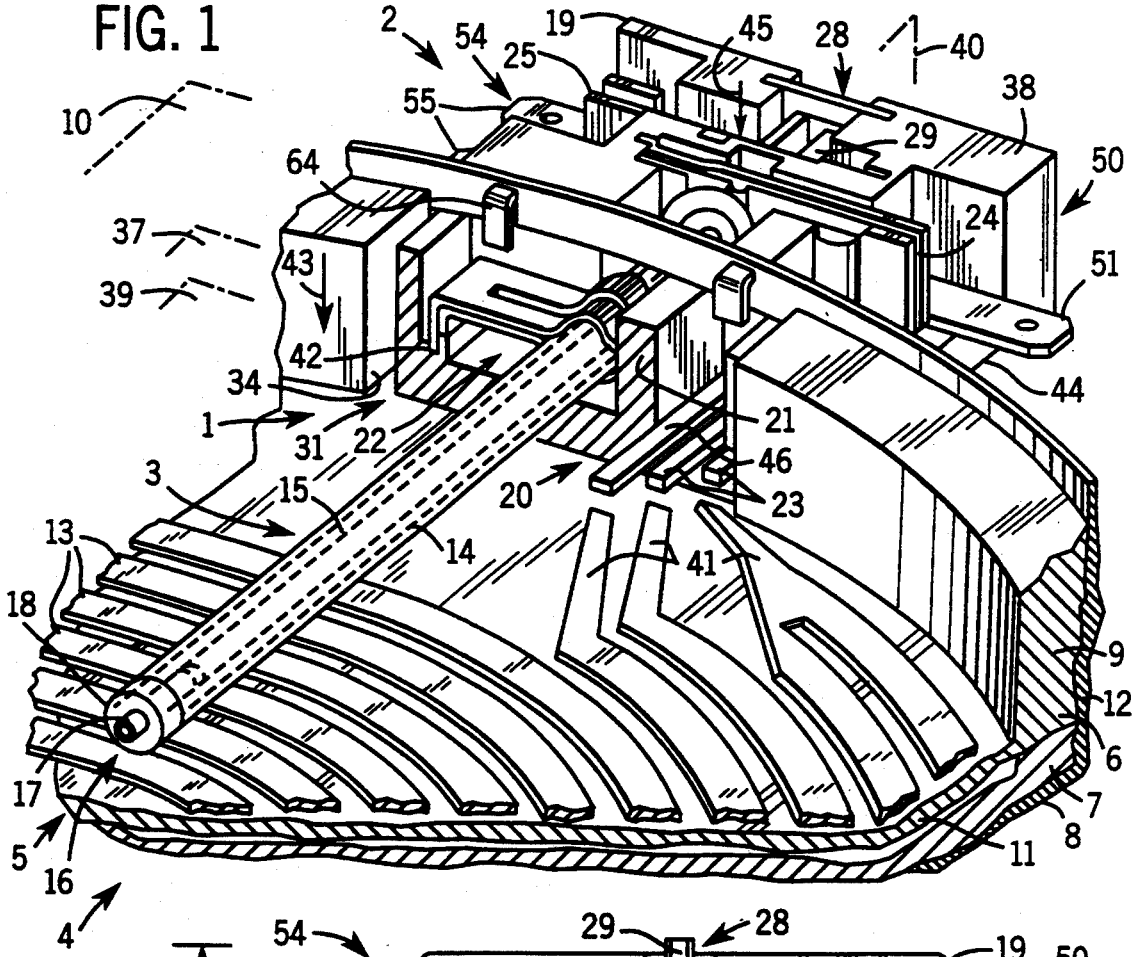
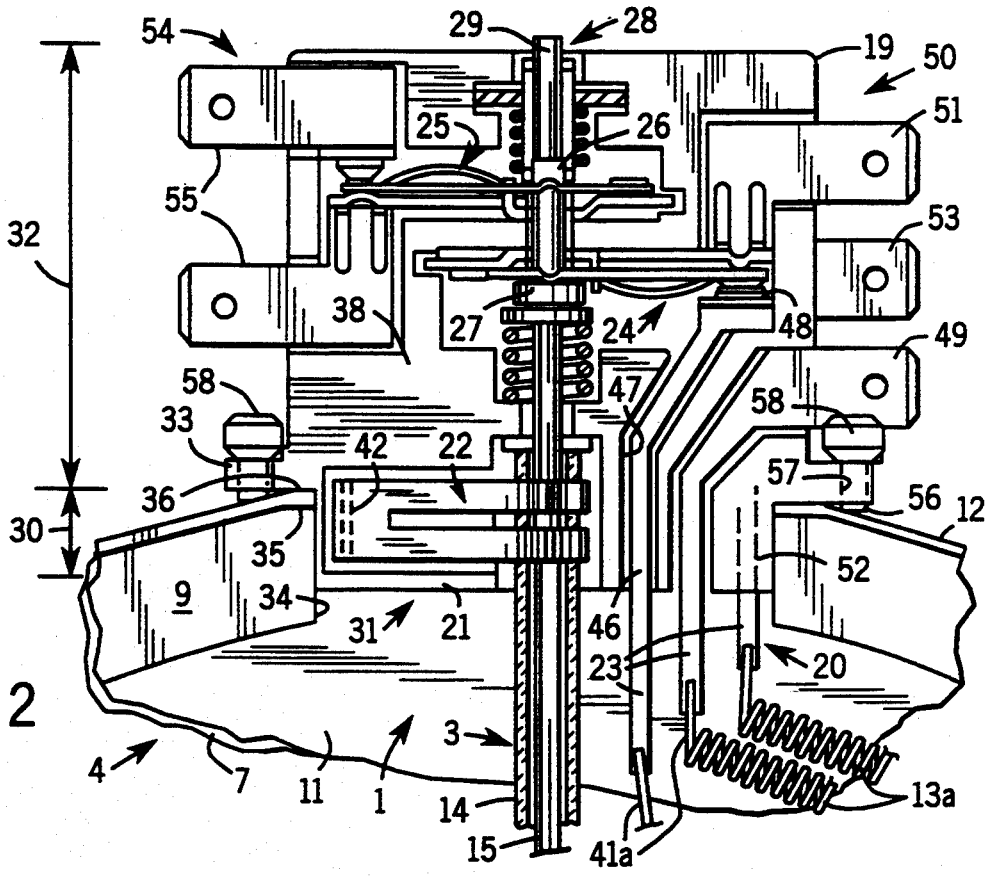
FIG. 2

FIG. 3
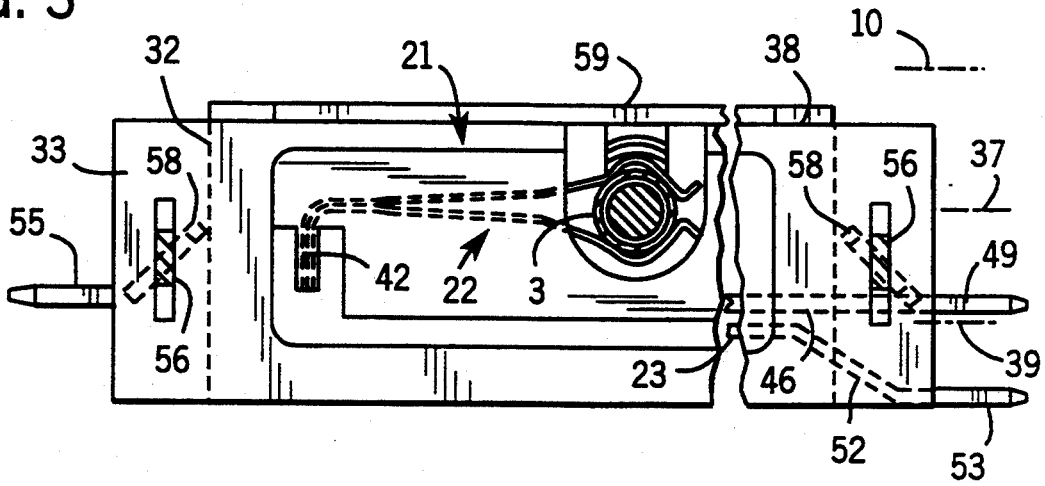
FIG. 4
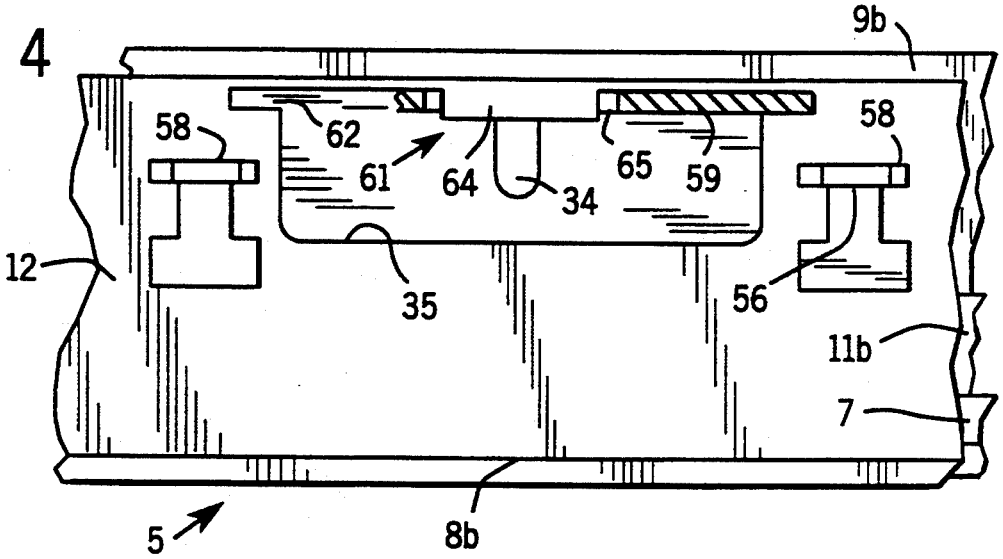
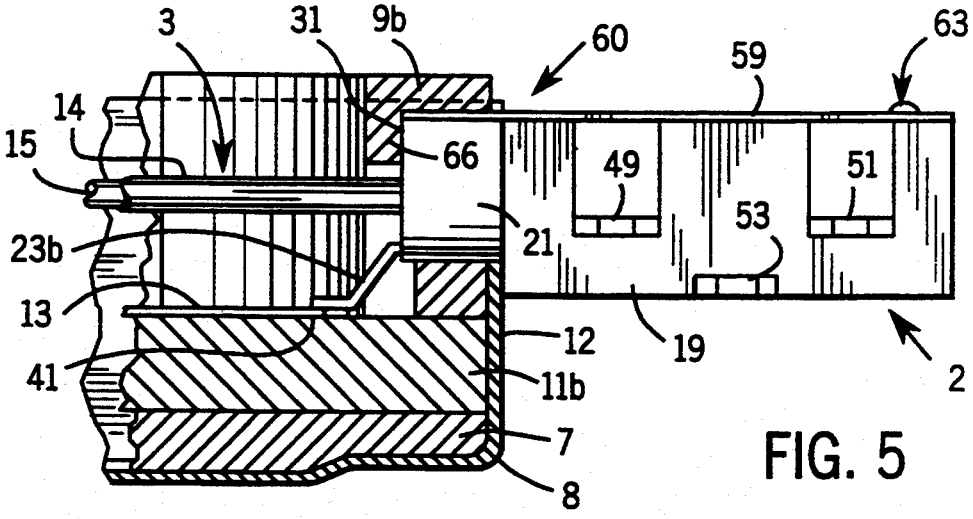
FIG. 5

TEMPERATURE DETECTION DEVICE

The invention relates to a temperature detection device with one or more control members, such as temperature sensors. Such devices are used e.g. for heating devices and the like used in the hone and which for the electrical power supply are provided with electrical connection points for connection to device lines. Heating devices can e.g. be heating units, such as radiant heating units for hotpoints, ovens, etc. The device appropriately has an enlarged head, one or more bases made from electrically and/or thermally insulating material, e.g. hard ceramic, which forms at least two base portions and which carries one or more control members in rod-like manner projecting over an outside and/or enclosed or flush within its outer faces.

The device base e.g. in the case of a temperature sensor operating with a thermal expansion fluid and consequently hydraulically can only carry the latter, but not the associated switch and/or e.g. in the case of a mechanically operating temperature sensor additionally at least one switch operated by the latter and is e.g. used for the manually settable temperature regulation and/or temperature limitation or as an overheating protection for the heating device, which on reaching an adjusted temperature limit disconnects part or all the power in automatic manner and on dropping below a corresponding lower temperature limit automatically connects it in again. The mechanical temperature sensor can e.g. be a bimetal sensor and/or an expansion rod sensor with two rod bodies extending over a common longitudinal area and made from materials with different thermal expansion coefficients. The rod bodies are fixed in the vicinity of a longitudinal portion so as to prevent longitudinal movements and fore in a longitudinal area remote therefrom control faces, which in the case of thermal changes perform longitudinal movements against one another and from which the desired operation or the associated operating force is derived.

The device with the base can be so fixed to an outside, e.g. an outer circumference of the heating device, that the temperature sensor is exposed to the heating action of at least one heating resistor or some other load of the heating device or projects into a corresponding heating area. In spaced manner adjacent to the device base it is possible to fix to the heating device an additional connecting piece with an insulator made from the said pressure-resistant insulating material and which has one or more connecting elements for the electrically conductive connection to at least one heating resistor. Connection takes place by means of a conductive intermediate part fixed to the heating resistor or, without an intermediate part, by direct fixing of the heating resistor to the connecting element. The heating resistor can e.g. be formed by a wire coil, a thick-film resistor or the like. If the connecting elements are connected by means of connecting conductors located outside the device base with connecting members for the device lines, a relatively complicated construction and fitting result. This is also the case if the device base contains at least one circuit breaker, which is connected by lines located outside the heating device, the device base and the connecting piece to an associated connecting member of the connecting piece and to at least one heating resistor in the manner described.

Instead of fixing the device base to the outer circumference, it can be fixed to the back or underside of the heating device remote from the heating plane of the latter. An engagement surface of the device base can then engage on said underside and connecting conductors can pass outside said engagement face adjacent to the exposed outsides of the base to the heating resistors. This construction is particularly suitable for mass hotplates and a separate connecting piece is inserted as the insulator in the underside, the connecting conductors being located a long way outside the device base and must be secured by separate insulators.

The problem of the invention is to provide a temperature detection device, which obviates the disadvantages of known constructions and of the described type and which, in the case of simple construction, ensures a very reliable electrical connection of the heating device to device lines.

According to the invention the device base has at least one connecting element for the electrical connection to at least one connecting part of the heating device in such a way that with the device base correctly located on the heating device said connecting element or the associated connecting conductors, except from a limited area, is not readily accessible from the remaining outsides of the device base or from the remaining outsides of the heating device.

Thus, apart from the temperature sensor, the device base also carries one or more connecting elements or connecting conductors, which, except for the associated connecting member, are only accessible in the vicinity of a corner zone of the face or the engagement face of the device base and therefore from the area in which the electrically conductive connection with the heating resistor is to be produced. Optionally excepting the connecting member, consequently the entire connecting conductor with its connecting element, without separate insulating enveloping, can pass in completely enclosed manner from the interior of the device base to the interior of the heating device and there is no need for a connecting piece to be fitted separately from the device base or in spaced manner adjacent thereto. Both the connecting piece and the device base can be fixed with a common fastening to the same point of the heating device, which also considerably reduces space requirements.

Instead of constructing the particular extension of one or more connecting pieces as a component separate from the device base, the positionally rigid operating connection between the device base and said extension can be obtained in a particularly simple manner by a common one-piece construction, so that the positionally rigid connection exists prior to the installation in the heating device. The extension can form a base portion engaging in substantially completely enclosed manner in the heating device, whereas the remaining device base is located freely on the outside of the heating device and is therefore accessible to good ventilation for cooling purposes. Such a free position is appropriately also assumed by the extension and/or the connecting element.

Instead of on separate base portions or extensions the temperature sensor and one to all the connecting elements necessary for the connection of the heating device are located in the vicinity of the same base portion. In a view of this face at least one connecting element can be located completely within the outer contour of the end face or that of the remaining base body or outside it. In a view of the heating plane the extension can form a narrower and in particular laterally freely projecting projection compared with a connecting portion of the remaining base body. The extension can also be suitable for securing the device base against tilting about axes transverse and/or parallel to the engagement side with respect to the support body.

The engagement side can form an almost continuous or only slightly set back and exposed intermediate portion of an inner face of the heating device, which e.g. in the form of an inner circumferential surface bounds the heated area on the outer circumference. Thus, there is no need for separate openings in the heating device for inserting connecting elements or intermediate conductors on the inside of the inner face and instead the engagement of the temperature detection device and one or all the connecting elements or intermediate conductors takes place through a common opening in the support body of the heating device. These and corresponding constructions can also be appropriate if the connecting piece is provided separately or spaced from the device base and optionally does not form therewith a closed subassembly for fitting to the heating device.

As a result of the described construction at least one connecting piece, instead of being at right angles is approximately parallel to the heating plane for assembly with the heating device, which significantly facilitates the fitting and construction of the insulator of the connecting piece, because the latter has no need for plugging grooves or other relatively complicated shapes for connection to the heating device. In addition, the connecting piece and temperature determination device can be jointly fitted to the heating device in a single operation.

The device base advantageously has outer boundary surfaces roughly at right angles to one another and appropriately it forms a flat block or casing, whose thickness is smaller than one or both its remaining edge dimensions. One or both of the thickness-limiting, larger outer faces at right angles to the end face are appropriately constructed as the assembly side, in that on assembling the device base the e.g. electrically conductive components to be fitted thereto and made from metal or the like are joined to the device base from and at right angles to said assembly side. In said side the base appropriately has corresponding depressions for the completely flush reception of the particular component.

One of these assembly sides in the fitted state of the temperature determination device is also provided as that side, which roughly parallel to the heating plane faces the latter and is set back with respect thereto by a gap, more components preferably being fitted from this side than from the other. This assembly side, which in the operating state can also form the roughly horizontal top of the device base, with the exception of any assembly depressions provided which pass through the same, passes substantially continuously or in planar manner over the entire device base and the connecting piece. Thus, all the areas can be closed with a common, dome-shaped and/or leaf spring-like cover with a thickness of less than 1 mm, which is flat and in particular in one-piece. In a view of said cover or top side of the device base or the connecting piece, all the connecting elements and temperature sensors are appropriately juxtaposed and/or parallel to one another, but the control member can be closer to the top side than at least one connecting element and/or at least one connecting element can be further removed from the top side than at least one further connecting element.

At least two or all the connecting elements can also be provided over their length with substantially continuous flat cross-sections in a common plane roughly parallel to the top side and/or parallel to the latter. Advantageously the connecting elements are made resilient by suitable joint zones at right angles to the heating plane or the top side and/or are positionally variable by permanent bending deformation, so that they can very easily be brought into direct contact with the associated end portions of the heating resistors or intermediate conductors. The end portion of the heating resistor which is at least in one piece over several centimeters can, without intermediate conductors, directly form the associated connecting part. To the latter are connected the connecting elements by welding or the like in non-detachable or adhesive and conductive manner.

From the particular connecting element by means of a switch or without a switch a connecting conductor leads to the associated connecting member provided for the operation of the heating resistors. Appropriately all the connecting members are freely projecting and accessible on the same connection side of the device base. This connecting side is at right angles to the end face and/or to the top side and is formed by a narrow edge of the device base, all the connecting members, connecting conductors and/or connecting elements appropriately being located entirely between and spaced from the planes of the top side and the side remote therefrom of the device base or the heating device. This advantageously also applies for the control member, the switch or switches or all the remaining components fixed to the device base.

One or more temperature determination devices can form together with the heating device a closed assembly, which is to be fixed to a suitable overall device or a glass ceramic plate defining the heating plane. In said assembly the particular device base can be connected in substantially clearance-free manner to the support body by bracing, locking and/or at least one snap connection. It is particularly advantageous if from the base body made from sheet metal or the like of the support body is shaped in one piece at least one fixing and/or locking and/or snap member by cutting free and/or bending, which engages in a corresponding countermember of the device base or a metal holder fixed thereto. This makes it possible to obviate the need for separate fastening members, such as fastening bolts, welded joints, etc.

In order to be able to easily reequip the connecting piece or device base to different connection or switching conditions, one or several connecting members, e.g. flat plugging tongues are formed by legs of a connecting body. The latter can be constructed as a punched bent part from material having roughly the seine thickness as the connecting elements, connecting conductors and/or connection tongues, which are optionally in each case constructed in one piece with a connecting conductor. In addition to one or more connecting members, the connecting body appropriately has a fastening leg appropriately at an angle thereto and/or directed away therefrom and which engages substantially congruently and in large-surface manner on a surface of the associated connecting tongue parallel to and/or facing the top side and is adhesively and non-detachably connected thereto by welding or the like. The connecting tongue is appropriately constructed as a connecting plug or flat plugging tongue, so that if the connecting body is not fixed thereto, it is suitable like all the remaining connecting members for easily detachable plugging connection with a mating connector of a device line.

A particularly advantageous fixing of the device base or the connecting piece to the heating device is obtained if the plugging, locking and/or snap connection is located directly between a casing cover of the device base or the insulator of the connecting piece and a component, such as a sheet metal tray, of the support body. The cover can be constructed in one piece with an associated fastening member, e.g. a plugging opening. This connection engages if the sensor or the connecting piece is transferred into an operating position with respect to the heating device. The cover is then positionally secured both with respect to the device base and connecting piece, as well as the heating device. The device base or connecting piece can also be positionally secured relative to the heating device additionally or only by said connection so as to prevent pulling apart counter to the fitting direction and so as to prevent raising of the cover, whilst no use is made of bolts between the base and the cover.

Spaced from this connection, the cover can be additionally centred with respect to the device base or connecting piece by engagement with its edge in a corresponding base depression and/or by pivotable mounting about a joint. The cover appropriately traverses the associated outer face of the heating device and projects with an end which e.g. closes the extension into the heating device, so that said snap connection can be inwardly displaced relative to said outer face.

Instead of or in addition to the principle of thermal material expansion, the temperature sensor can also operate according to another principle and preferably has fixed sensing bodies, which exert the mechanical switching or operating force. The sensing part transferring the operating force can be under compressive or tensile stress in operation or the outer tube or inner rod and different constructions are conceivable in accordance with DE-OS 35 40 414, 37 05 260 and 39 13 289 (EP-9 01 05 986.5-2211), to which reference should be made for further features, effects and advantages for the purpose of incorporation into the present invention. The same also applies with respect to the adjustment of the sensor, which can be constructed in accordance with patent application P 40 92 351.3.

These and further features can be gathered from the claims, description and drawings and the individual features, both singly and in the form of subcombinations, can be realized in an embodiment of the invention and in other fields and can constitute advantageous, independently protectable constructions for which protection is hereby claimed.

The invention is described in greater detail hereinafter relative to non-limitative embodiments and the attached drawings, wherein show:

FIG. 1 A temperature determination device according to the invention in an assembly with a heating device shown in detail in perspective view.

FIG. 2 The arrangement according to FIG. 1 in plan view and in a slightly modified construction.

FIG. 3 A view of the engagement side of the device according to FIG. 1.

FIG. 4 A detail of the heating device in a view of the outside.

FIG. 5 An assembly according to FIG. 1 in axial section and modified construction.

FIG. 6 An embodiment for a fastening in perspective view of the underside of a detail of the device base.

Figure 7:
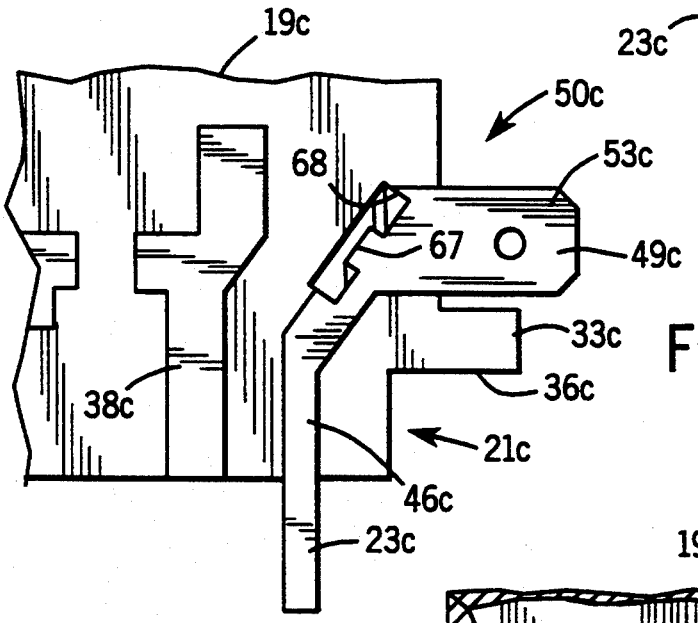

FIG. 7 The arrangement according to FIG. 6 in a view of the top side.

Figure 8:
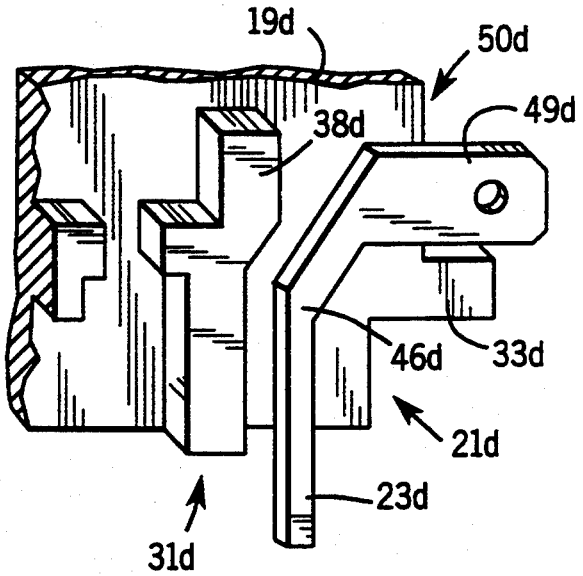

FIG. 8 Another embodiment corresponding to FIG. 7, but in perspective.

Figure 9:
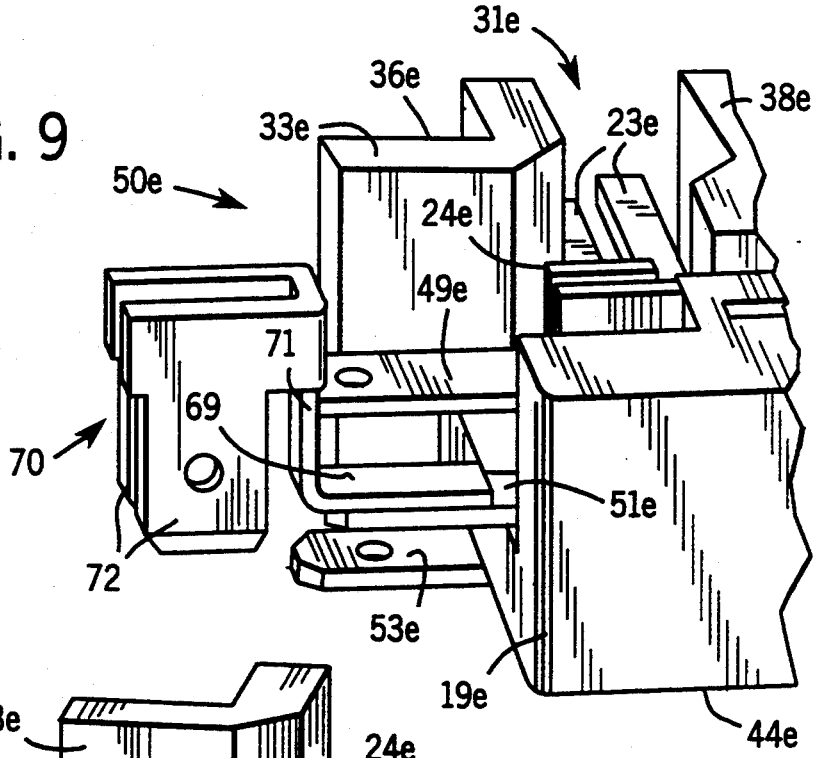
Figure 10:
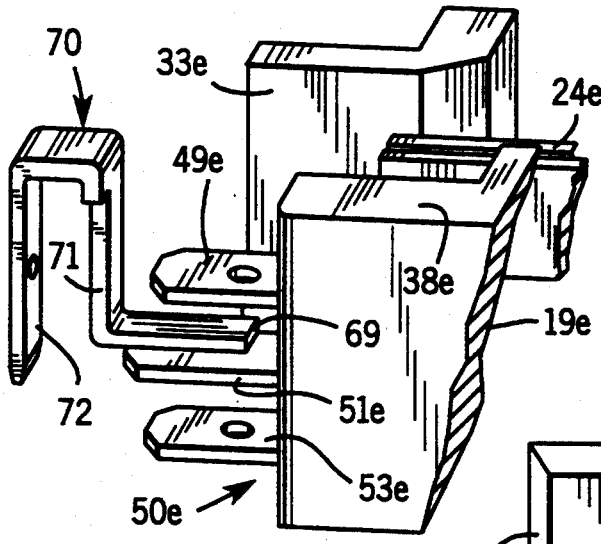
Figure 11:
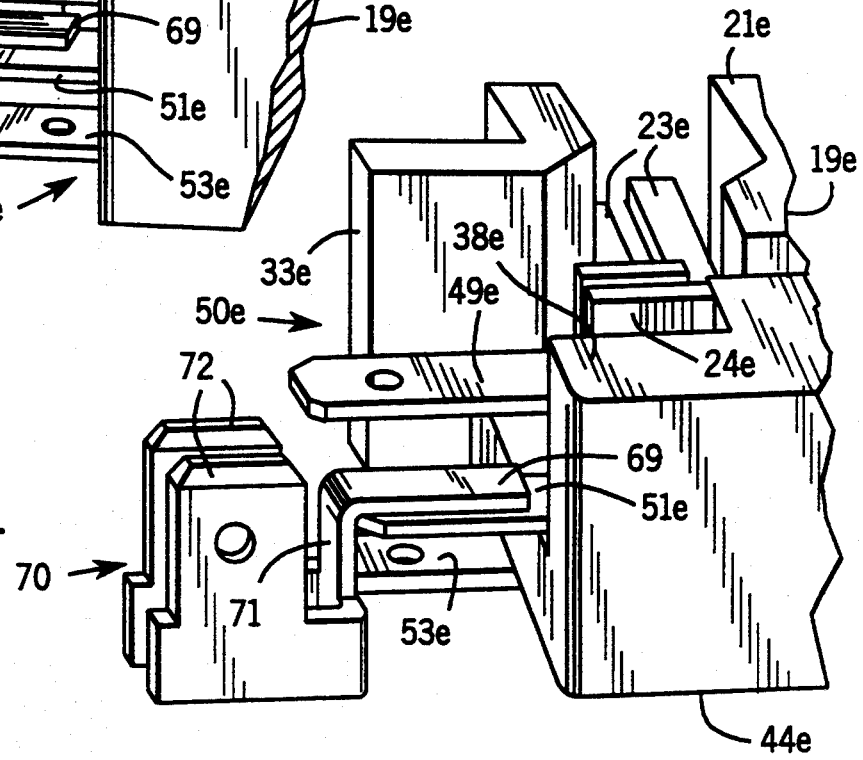

FIGS. 9 to 11 Embodiments for the device connecting area of the device base in perspective details.

Figure 12:
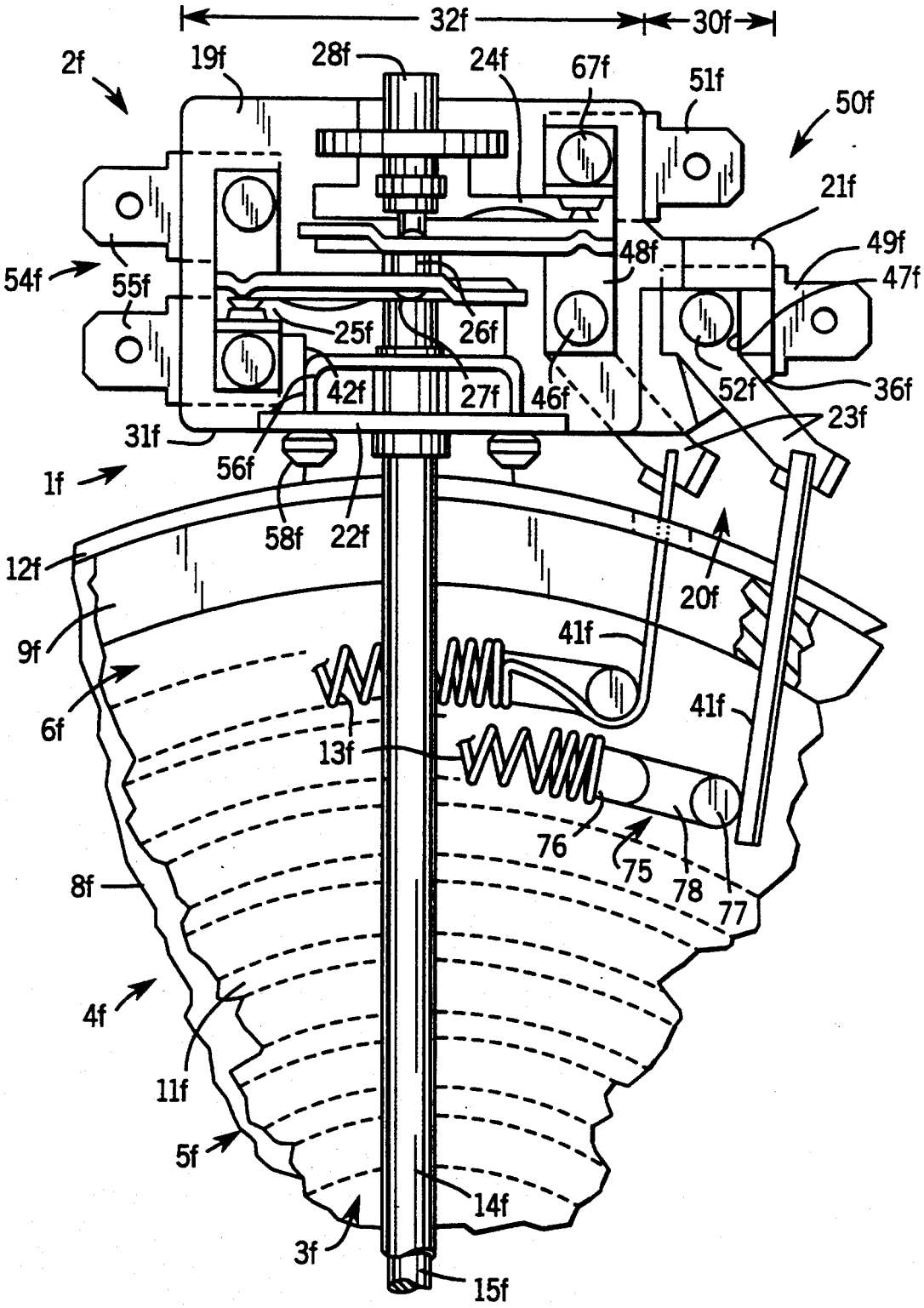

FIG. 12 A further embodiment of a temperature determination device in assembly with a heating device shown in detail and plan view.

Figure 13:
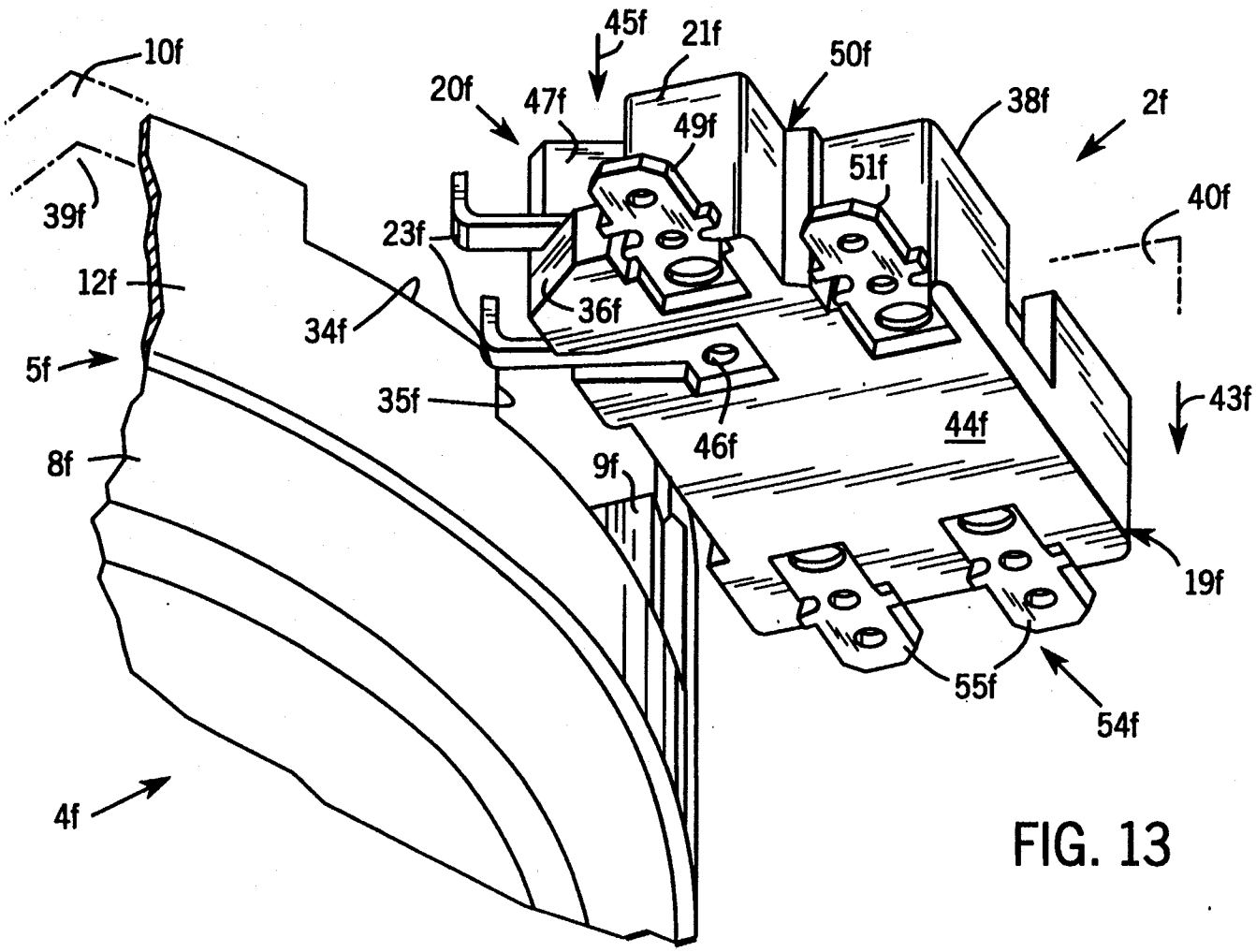

FIG. 13 A detail of FIG. 12 in a perspective view sloping from the bottom.

Figure 14:
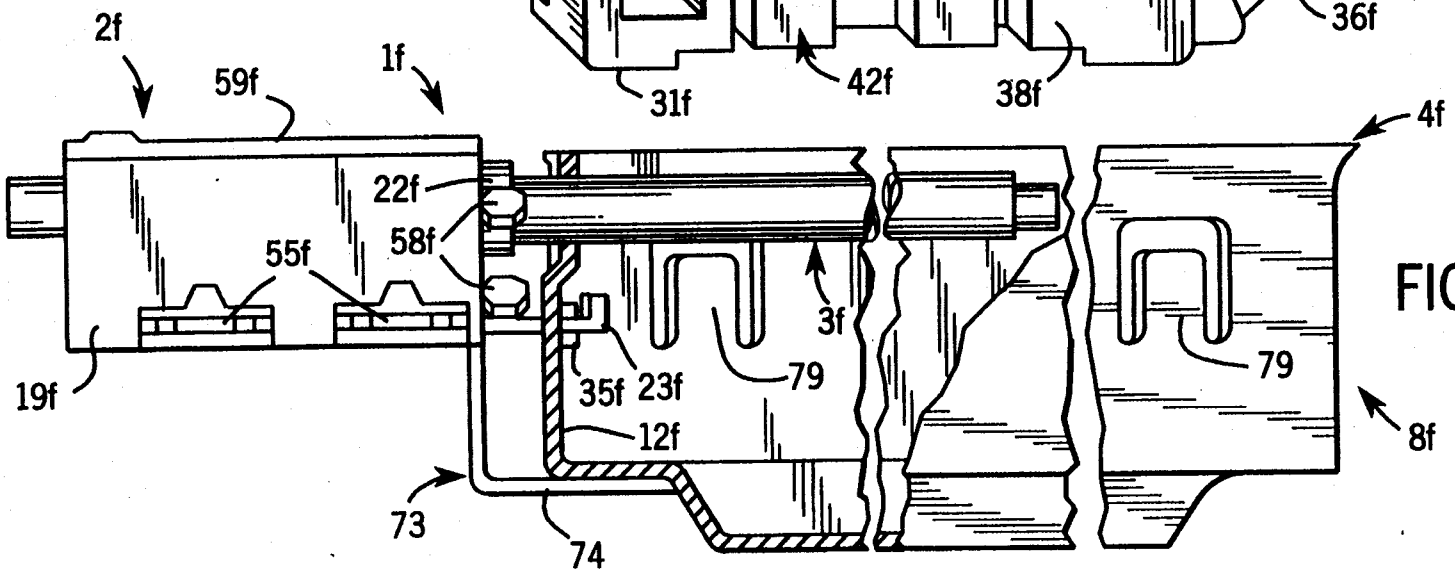

FIG. 14 The arrangement according to FIG. 12 in a part sectional side view.

Figure 15:
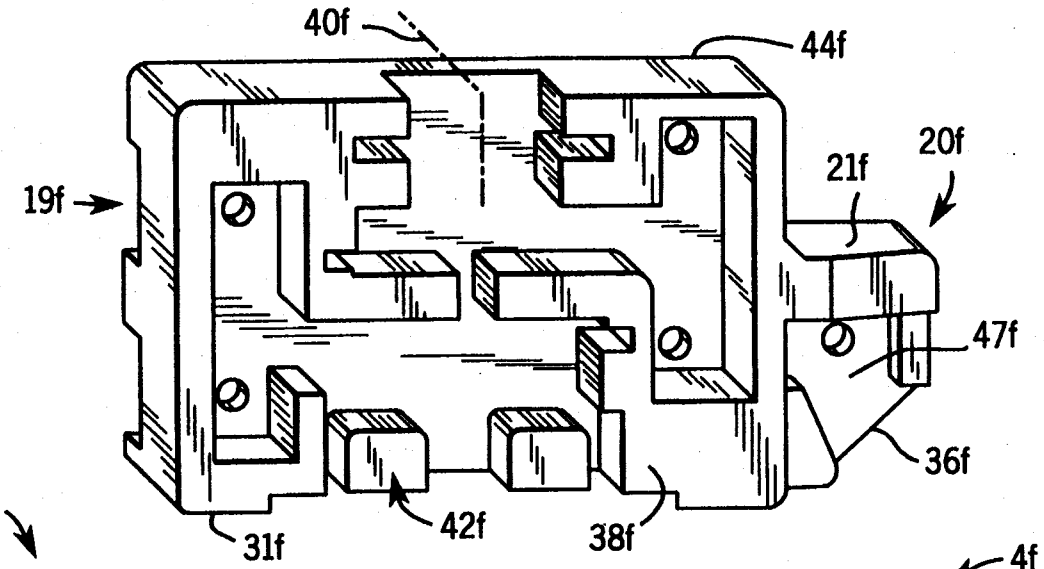

FIG. 15 The device base according to FIGS. 12 to 14 in a perspective view of the top.

The temperature determination device 1 has a widened head 2 and as a control member a rod-like, thin, substantially cylindrical, through temperature sensor 3. In longitudinal view the control member is spaced from and within the outer contour of the device head and projects freely over an outside of the device head 2 with most of its length. The device 1 is used for fixing to a heating device 4, which is here a radiant heating unit.

The heating device 4 has a flat or shallow dish or tray-like, multipart support body 5 with a dish-shaped insulator 6, a plate-like insulator 7 and a protective or support dish or tray 8 made from sheet metal or the like as a supporting reinforcement. The insulator 7 rests in substantially completely covering manner on the bottom of the support dish 8 and between the latter and the insulator 6 in such a way that the insulator 7 is supported with respect to the bottom substantially only in the vicinity of an outer ring zone, In this area the insulator 6 has an insulating edge 9 projecting in ring-like manner to the open dish side over its insulating bottom 11. Within the inner circumference thereof the top of the insulating bottom 11 is substantially free and the outer circumference is in engagement with the inner circumference of the approximately cylindrical dish jacket 12 of the support dish 8.

The insulating bottom 11 and the insulating edge 9 are constructed in one piece from a compressed, electrical and thermal insulating material, which contains ceramic fibres and as a shaped body is mechanically inherently stable, but is not pressure-resistant. The insulator 7, which has better thermal insulating characteristics can be made from compressed loose material of reduced strength. As a function of whether the insulating jacket 9 or the dish jacket 12 projects slightly further on the open dish side, the corresponding face forms a bearing face located in a bearing and heating plane 10, with which the heating device 4 is to be resiliently pressed against the back of a translucent plate or a support profile receiving the latter in such a way that the dish area is substantially sealed to the outside.

The cover or top sides for said heating device 4 and the device 1 are the sides located towards the open dish side and towards the heating plane 10. However, they can also assume an overhead, an upright or an inclined operating position. On the top of the insulating bottom 11 in one or two or more separately switchable heating circuits is provided a corresponding number of heating resistors 13 or 13*a* in concentric spiral turns extending from the insulating edge 9 to a central area. They can e.g. according to FIG. 1 be electrical thick-film resistors and according to FIG. 2 wire coils, metal meshes, light bulbs in the manner of halogen bulbs or the like, as well as a mixture of such different heating resistors.

The temperature sensor 3 is located in substantially contact-free manner in the space and is spaced from and between the heating resistors 13 and the heating plane 10 roughly parallel to the approximately planar insulating bottom 11. With most of its extension parallel to the temperature sensor 3, the device head 2 is located freely on the outside of the heating device 4 and namely connecting on to the outer circumference of the support body 5, the device head 2 being located between and spaced from both the heating plane 10 and its remote underside of the heating device 4 or the support body 5, so that it only projects over the jacket surface of the heating device 4.

The temperature sensor 3 or part of the device head 2 traverses the dish jacket 12 and the insulating edge 9, over whose inner circumference the temperature sensor 3 projects transversely over the heating resistors 13. Thus, the temperature sensor 3 is heated by the direct radiation from the heating resistors 13, the back radiation of the plate or a cooking vessel placed on the latter and the air temperature within the substantially closed device area, so that the temperature sensor always assumes a temperature, which is in the range of the highest temperature occurring through the operation of the heating device 4 and which is at least as high as the highest temperature of the glass ceramic plate in the vicinity of the heating device 4.

The temperature sensor 3 has two reference bodies extending substantially over its entire length having different thermal expansion coefficients. Of said bodies one can be made from a mineral or ceramic material with the lowest expansion coefficient and another from a metallic material, e.g. steel with a relatively high expansion coefficient. The reference bodies here are formed by an outer tube 14 made from quartz glass and an inner metal red 15 inserted therein with radial clearance and both of which are in the form of strand sections with constant cross-sections over their entire length and after cutting to length from in each case one profile rod require no further reworking or machining.

In the vicinity of the free end remote from the device head 2 the outer tube 14 and the inner rod 15 are reciprocally fixed in the longitudinal direction thereof by an adjusting means 16. The latter has an abutment 18 engaging on the associated end face of the outer tube 14 having approximately the same outside width and a bolt-like, thread-free adjusting member 17 inserted in the central bore thereof. The adjusting member 17 projecting freely to the outside initially engages in substantially radial clearance-free, but longitudinally displaceable manner into the abutment 18 and after adjustment is non-detachably connected to the abutment 18 by an adhesive or welded connection. The inner end face of the adjusting member 17 located within the outer tube 14 then forms a pressure engagement surface for the associated, outer end face of the inner rod 15.

The outer faces of the device head 2 are substantially formed by a device base 19 made from pressure-resistant, electrical insulating material, such as a hard ceramic material. The inner ends of the outer tube 14 and the inner rod 15 located at or within the device base 19 form reference or control faces which, as a result of the temperature changes of the temperature sensor 3, perform longitudinal movements against one another and said relative movement is used for deriving a corresponding operation. The inner end of the inner rod 15 projects over that of the outer tube 14, whose face engages under spring pretension on a shoulder face of the device base 19. The inner end of the inner rod 15 carries, e.g. by a threaded connection, in longitudinally adjustable manner a widened collar, whose inner end face forms the associated control face 27.

The inner end of the inner rod 15 acts on a rod-like operating member 26 made from electrically insulating material or the like and which is displaceably mounted with the rod 15 in approximately aligned manner within the device base 19. Within pocket-like depressions the device base 19 contains two successive flat switches 24, 25 in the form of snap-action switches, which succeed one another in the longitudinal direction of the temperature sensor 3 and which are essentially located in a main plane at right angles to said sensor 3. One of these switches can be a circuit breaker 24 for the direct switching of the heating resistors 13 and the other can ba a signal switch 25 for the control of an indicating or display means, such as a hot indication.

In the case of thermal length extension of the inner rod 15, the control face 27 acts directly on a contact or snap-action spring of the switch 24 in the sense of a forcibly controlled contact opening. A corresponding control face provided on the operating member 23 in the case of such a length extension also acts directly on such a spring of the switch 25 in the sense of releasing said switch for the automatic resilient following movement into its closed position.

The adjusting means 16 is provided for the switch 25, whilst the adjusting means 28 for the switch 24 is accessible from the side of the device head 2 remote from the temperature sensor 3. The adjusting member 29 of said adjusting means 28 makes it possible to adjust the control face 27 with respect to the remaining inner rod 15.

Laterally adjacent to the temperature sensor 3, the device base 19 forms a connecting piece 20, which serves as an intermediate piece for the electrical conductive connection of the heating resistors 13 and the not shown device lines. The insulator of said connecting piece 20 is formed by an extension 21 of the device base 19 and said extension 21 on either side of the temperature sensor 3 passes through in unitary manner in such a way that the sensor 3 is roughly located in the centre of its width and/or height or that of the remaining device base 19. On the side remote from the connecting piece 20, the extension 21 receives in enclosed manner a mounting support 22 for the temperature sensor 3 and in the vicinity of the connecting piece 20 receives connecting elements 23 for the electrically conductive connection to the heating resistors 13.

Three parallel connecting elements 23, whereof at least one could also be located within the extension 21, project parallel to one another and to the temperature sensor over the end face traversed by the latter or the engagement side 31 of the extension 21, which according to FIG. 2 passes in step-free or planar manner up to the circumferential surfaces of the extension 21. Lateral, web-like flanges 33 project over the two lateral faces of the extension 21 at the rear end and like the extension 21 are constructed in one piece with the remaining device base 19 from an insulating material, such as hard ceramic and also project laterally over the remaining device base 19.

From the engagement side 31 to the front, approximately equiplanar faces of the flanges 33, the device base 19 forms a front base portion 30 and from said point to its rear end a rear base portion 32. Compared with its width, the extension 21 has a much smaller length and forms a plugging projection projecting freely in the same direction as the temperature sensor 3 and whose outer faces are roughly parallel to the plugging direction and at least partly are substantially smooth-surfaced. In a longitudinal view of the temperature sensor 3 the base portion 32 or the remaining base part located behind the flanges 33 can project laterally on one or both sides, on the underside and/or on the top side.

With the extension 21 the device 1 is inserted in engagement openings 34, 35 of the heating device 4, namely the insulating edge 9 and the dish edge 12, roughly in the longitudinal direction of the temperature sensor 3 and redial to the heating device 4 or parallel to the heating plane 10. According to FIG. 1, the extension 21 can have a lateral spacing from at least one engagement opening or, according to FIG. 2, can be connected laterally in substantially clearance-free manner to the associated boundaries of one or both engagement openings. With its planar underside the extension 21 can rest in large-surface manner on the insulating bottom 11, the insulator 7 and/or a shoulder face of the insulating edge 9 which is higher and flush with respect to the top of the insulating bottom 11, so that there is a very good centring and supporting of the device 1 with respect to the heating device 4. Simultaneously the extension 21 or the base body 19 can substantially tightly close the heating device 4 in the vicinity of the engagement openings 34, 35, so that following the fitting of the entire assembly to the plate a sealed, heated area is formed.

The front faces of the flanges 33 form bearing surfaces 36, which on either side laterally engage in closing manner on the outer circumference of the dish edge 12. Correspondingly the front face of the base portion 32 located in the plane of the bearing faces 36 can then engage on the lower boundary of the engagement opening 35 and/or on its upper boundary so as to have a closing action on the outer circumference of the dish edge 12, which leads to a frame-like, closed engagement around the engagement opening 35. Appropriately said bearing surfaces 36 are fixed against the circumferential surface.

The thus accurately oriented connecting elements 23 and the temperature sensor 3 are still resiliently arranged together with the device head 2 with respect to the electrical heating means, because the head 2 through its substantially clearance-free connection to the dish edge 12 and the parts of the insulator engaging on the extension 21, forms a spring arrangement. As a result of the latter in particular elastic tilting movements about axes parallel to the heating plane 10 are possible. The temperature sensor 3 can move by a small amount in all directions at right angles to its central axis with respect to the device base 19 and by the mounting support 22 is returned resiliently to its starting position, so that it is damped with respect to powerful impact loads.

The straight temperature sensor 3 is located in a plane 37 roughly parallel to the heating plane 10, from which it is somewhat further removed than the also parallel top side 38 of the device base 19. The connecting elements 23 pass out of the engagement side 31 in at least one plane 39. This connecting plane 39 is further removed from the heating plane 10 than the plane 37, but is at a limited distance above the insulating bottom 11 and the heating resistors 13. All the connecting elements 23 are on one side of the axial plane 40 of the straight temperature sensor 3 at right angles to the heating plane 10, whilst the mounting support 22 is substantially located on the other side.

The outer spiral arcs of the heating resistors 13 are constructed in the vicinity of the connecting elements 23 and adjacent to the inner circumference of the insulating edge 9 as connecting parts 41 directed against the latter. These are in one piece with at least a half or a complete spiral arc of the heating resistor 13 and serve for direct connection to the associated connecting element 23. The initially slightly vertically displaced connecting elements 23 overlapping with gap spacing the associated connecting part 41 can, as a result of the resilient or deforming bendability thereof, be brought at right angles to the insulating bottom 11 into contact with the connecting part 41 and can then be joined to the latter by welding.

In the case of FIG. 1 the connecting parts 41, like the remaining heating resistors 13, are anchored by whole-surface fixing up to the free ends thereof with respect to the insulating bottom 11, whereas according to FIG. 2 the connecting parts 41*a* are formed by linear end portions of the wire coils and therefore for bringing together with the connecting parts 23 can be moved with respect thereto.

On its top surface 38 the device base 19 has a larger number of depressions, in which are inserted the temperature sensor 3, the switches 24, 25, two connecting elements 23 closest to the sensor 3 and further components, such as connecting members, tension springs, etc. at right angles to the top 38 in an assembly direction according to the arrow 45. In a plugging direction according to arrow 43 parallel thereto the mounting support 22 is inserted in such a way that it is held in self-locking manner by a plug connection 42, which is located on the side of the temperature sensor 3 remote from the connecting piece 20.

Each connecting element 23 passes in one piece and with substantially the same cross-sections into a connecting conductor 46 located within the base portions 30, 32 and which is in each case located in a separate groove 47 in the top side 38. The connecting conductor 46 is located substantially over its entire length in the plane 39 on the groove bottom. The connecting conductor 46 closer to the temperature sensor 3 passes in one piece into an angled contact support 48 for the switch 24 located closer to the engagement side 31. The connecting conductor 46 adjacent thereto passes in one piece into a connecting member 49, which roughly parallel to the top side 38 and at right angles to the temperature sensor 3 projects freely out of a first connecting side 50 of the device base 19.

In a view of the top side according to FIG. 2 said connecting elements, connecting conductors and contact or connecting members are in the vicinity of a reentrant corner zone, which is bounded on one side by the temperature sensor 3 and on the other side by the switch 24. A further identical connecting member 51 projects on the connecting side 50 being rearwardly displaced with respect to the connecting member 49. It is provided for the switch 24 and constructed in one piece with its switch carrier. The connecting members 49, 51 could be located, e.g. as flat plugging tongues, in a common plane. The connecting side 50 is at an angle to the engagement side 31 and to the top side 38 following onto the back of the associated flange 33.

The third, shortest connecting element 23 furthest removed from the temperature sensor 3 is inserted from the underside 44 remote from the top side 38 into the device base 19, including its connecting conductor 52, into a corresponding groove-like depression. According to FIG. 2 its connecting member 53 projects freely between the connecting members 49, 51 on the connecting side 50.

According to FIG. 3 said connecting conductor 522 can rise from the connecting member 53 within the device base 19 by bends to the plane of the associated connecting element 23 and is consequently not located in a single plane like the other connecting conductors. On the side remote from the connecting side 50, the device base 19 forms a second connecting side 54 with freely projecting connecting members 55 for the switch 25. These flat plugging tongues can be located in the plane of the connecting members 49, 51 and, like the latter, are provided between the planes on the one hand of the rear base end and the back of the flanges 33 and on the other the top side 38 and the underside 44.

After inserting the device 1 in the heating device 4 it is only necessary to secure against remove counter to the plugging direction and optionally for the clearance-free bracing with respect to the support body 5 or the support dish 8. For this purpose on either side and laterally of the engagement opening 34 or 35 only two fastening members 56 are required, which are in each case located between the top side 38 and the underside 44 roughly in the centre of the height or thickness of the base portion 30 or 32. At least one or all the fastening members 56 are constructed in one piece with the dish jacket 12 and project roughly at right angles from its outer circumference with a shaft portion, which has an interlocking member at the free end as the head 58.

Prior to interlocking the head 58 can be provided in a plane at right angles to the top side 38 according to FIG. 3 or in a plane roughly parallel thereto according to FIG. 4. As an engagement member 57 for the shaft of the fastening member 56, each flange 33 has a slot-like passage opening defined over the entire circumference. It is closely adapted to the head 58 and through it passes the latter on inserting the device 1 into the engagement openings 34, 35. The head 58 is then rotated about the shaft axis and consequently braced with respect to the back of the flange 33, so that the device 1 with the bearing faces 36 is drawn against the outer circumference of the dish jacket 12.

The engagement side 31, which in the manner of an end wall can have relatively closely adapted passage openings for the temperature sensor 3 and/or the connecting element 23 and consequently forms a thermal shield, then defines in the vicinity of the engagement opening 34 the inner circumference of the heated area as an almost continuously connecting intermediate portion. At least one or all the fastening members could also be snap members, which on inserting the device 1 automatically snap into a positive locking position because the device 1 through the engagement of the extension 21 is already positively secured against movements in all other directions and only has a limited movement clearance. This is particularly the case if the parts made from insulating material engage with pretension on the associated outer faces of the extension 21 in such a way that they are resiliently compressed in this area and can therefore be particularly tight. After fitting the base portion 32 with all the switches 24, 25 and connecting members is located outside the heating device 4.

Substantially all the depressions of the device base 19 emanating from the top side 38 are closed with a sheet-like, planar cover 59, which extends from the rear base end to over the extension 21 and approximately up to the plane of the engagement side 31 and over which laterally projects the flanges 33. The plastic cover 59 has the spiral spring characteristics of a leaf spring and has over its entire length a substantially constant width, so that in the vicinity of the extension 21 it projects on both sides laterally over the latter.

Instead of or in addition to the fastening members 56 said cover 59 can be incorporated into a securing means 60 for fixing the position of the device 1 relative to the heating device 4. For this purpose the cover 59 by means of one or more approximately symmetrical to the centre of its width or to the axial plane 40-positioned snap connection 61 and by engagement in slots 62 is brought into direct engagement with the dish edge 12. In addition, at a distance therefrom or from the dish edge 12, e.g. at a limited distance from its and the rear end of the device base 19, the cover 59 is fixed by a centring means 63 parallel and/or at right angles to its plane with respect to the base 19.

The centring means 63 can be a depressed receptacle of the cover 59 in the device base 19, a plug connection of plugging or snapping members constructed in one piece with the device base 19 and the cover 59 and/or a connection with a separate fastening member, e.g. a clinch bolt. The bolt engages in aligned openings of the device base 19 and the cover 59 in such a way that the latter can be pivoted between a closed and an open position with respect to the base 19 in its plane.

The snap connection 61 has a snap member 64 constructed in one piece with the support dish or tray 8 and appropriately projects in web-like manner from the upper boundary of the engagement opening 35 to its facing boundary. Only a closely adapted opening need be associated with the snap member 64 as a counter-member or snap opening 65 in the cover 59. In addition, the engagement opening 35 in an extension of its associated upper boundary or in the vicinity of the lateral edges of the cover 59 is widened by slots 62, in which engage the edges of the cover 59 projecting laterally over the extension 21 with a slight sliding fit. Thus, the cover 59 is positively secured against movements transverse and parallel to its plane through the support body 5.

On inserting the device 1 in the heating device 4 the edges of the cover 59 are guided in the slots 62 at the start of the engagement of the extension 21 in the engagement opening 35. Simultaneously the snap member 64 slides on the outside of the cover 59 because the latter and/or the snap member 64-carrying area of the dish edge 12 is resiliently pressed back. At the end of the insertion movement the snap member 64 automatically snaps into the snap opening 65 and as a result the base portion 32 is secured against tilting movements away from the heating plane 10.

In the case of the construction according to FIG. 3 the cover 59 is at a limited distance from the top of the extension 21, whilst according to FIG. 5 it also closes the extension 21 engaging on the top. According to FIG. 1 the snap members 64 can be laterally displaced against one another and/or inwards or outwards by bends with respect to the circumferential surfaces of the dish edge 12.

According to FIG. 2 both the engagement opening 34 and the engagement opening 35 is open to the full width to the heating plane 10. The engagement opening 35 according to FIG. 4 is slot-like at right angles to the heating plane 10, but its width is closely adapted to the outer circumference of the temperature sensor 3, so that the latter can in unhindered manner perform slight movements at right angles to the heating plane 10. However, according to FIG. 5, the engagement opening 34 can be completely closed over its circumference, particularly if the insulating edge 9b is formed by a component separate from the insulating bottom 11b, which stands up in full surface manner on the top of the insulating bottom 11b. Connecting on to the engagement side 31, the insulating edge 9b can form an end wall 66 of a pocket, which is accessible from the cuter circumference of the insulating edge 9b for receiving the extension 21, engages on the extension 21 over substantially the entire outer circumference and its bottom is traversed by the engagement opening 34. Therefore the end wall 66 forms a further thermal insulation for the components in the device base 19.

According to FIG. 5 the extension 21 is spaced above the top of the insulating bottom 11b. One to all the connecting elements 23b are twice angled in opposition to one another, so that the joints parallel to one another and to the plane of the heating resistors 13 are formed. They make it possible to resiliently adjust the free connecting end of the connecting element 23b transversely to the insulating bottom 11b without it changing its parallel position to the connecting plane.

The outer turn ends of the heating resistors 13, 13a, 13b to be connected to the connecting elements 23 can also pass transversely to the temperature sensor 3 between the latter and the insulating bottom 11 or traverse the axial plane 40. For example, if the mounting support 22 and the connecting piece 20 are arranged in side-inverted manner with respect to the represented construction on either side of the temperature sensor 3 or if the winding direction of the coils of the heating resistors 13, 13a is reversed with respect to the direction shown, so that the heating field can be occupied with heating portions upstream of the engagement side 31 of the device 1. In the represented embodiment upstream of the connecting piece 20, the exit of the temperature sensor 3 from the device base 19 and the mounting support 22 is provided an unheated area, whose width is approximately two to four turns of the heating resistors 13. This area of the device head 2 projecting into the heating device 4 is consequently only thermally stressed to a relatively small extent.

As a result of the described construction for connecting the heating resistors 13, 13a, 13b no connecting conductor located outside the device head 2 and base 19 or the heating device 4 is required. Both in a view of the heating plane 10 and in a view parallel to the heating plane 10 and at right angles to the central plane 40, all the connecting conductors 46, 52 are substantially entirely located within the common outer contour of the heating device 4 and the device head 2. The unswitched connecting conductors 46, 52 are also located within the device base 19. The connecting conductors or connecting elements could admittedly be positioned between the device base 19 and the outer face of the support body 5 so as to bridge in unprotected, uninsulated manner a small gap and would then only pass out of the device head 2 within the heating device 4. In each case all the connecting elements and connecting conductors can be constructed as bare metal parts without any separate insulating envelope. They could be exclusively electrically insulated by the base portions 30, 32 and the insulating support of the heating device or could be protected against undesired contact by the position in the vicinity of the gap.

The individual metallic components arranged in fixed manner on the device base 19 and in particular the connecting elements, connecting conductors and associated connecting members can be secured in substantially clearance-free manner with respect to the base body and so as to prevent relative movements in a number of ways. It is particularly appropriate if, according to FIGS. 6 and 7, the corresponding component is provided with one or more angled bending or interlocking members 67. There is a plugging opening 68 in the device base 19c for the passage thereof. Following the insertion of the component from one side 38c in the device base 19c, the part of the interlocking member 67 projecting over the other side 44c can be correspondingly bent and consequently braces the component against the associated assembly face.

The components having the connecting elements 23c have between the element 23c and the associated connecting member 53c an intermediate portion angled or inclined with respect thereto in a view of the top side 38c. Its one bend can be located roughly in the centre of the length of the associated connecting conductor 46c. In this case the interlocking member 67 is appropriately closer to the free end of the connecting member 53c than the connecting element 23c, e.g. following onto the inner end of the connecting member 53c. Thus, the connecting element 23c with the associated portion of the connecting conductor 46c can be moved relatively easily transversely to the heating plane with respect to the base 19c or can be raised from its bearing surface. At least one of the support webs of the switches 24, 25 can be fixed with at least one of the said members.

According to FIG. 8 at least one of the said components can also be fixed by means of an adhesive connection to the device base 19d and it is preferably thermally stable to at lest 200° or 300° or even 400° to 500° C. Thus, no fixing parts need project over the fixing face of said component and non electrically conductive parts can be fixed in this way to the base 19d. The adhesive connection is appropriately of such a type that it is obtained by heating and/or pressure and subsequent cooling. The heating temperature, e.g. the melting point for producing the adhesive action, can be above the maximum thermal loading of the device 1. The connecting coating separate from the device base 19d and the component to be fixed can be a solder coating, a thin ceramic or glass coating, etc. It is appropriately applied to the assembly or fitting surface by lining or pressing on and only then does the connection to the connecting face of the particular component occur.

The thickness of the connecting coating is appropriately in the in range, so that the connecting face of the component can in part directly engage on the assembly face of the device base 19d or is only at a spacing therefrom of the above order of magnitude. The connecting coating material is appropriately such that it penetrates both the pores of the assembly surface and those of the connecting face and is therefore anchorable in non-detachable manner.

In order to easily produce the device 1 for different connection conditions determined by the main appliance or its lines, one to all the connecting members 49e, 51e, 53e according to FIGS. 1 to 11 are constructed as support bases for one or more connecting members 70 from which the particular one projects over the free end of the associated connecting member 51e. The connecting member 70, which is appropriately constructed from the same sheet metal material as the connecting members in the form of a stamped bent part, has a freely projecting, angled fixing leg 69, whose width is approximately the same or smaller than the width of the associated connecting member 51*e* and its length is of the same order of magnitude as the connecting member 51*e*.

The cross-sectionally flat rectangular fixing leg 69 can be applied with one flat side in substantially full-surface manner to the lower or upper flat side of the fastening member 51*e* and can be connected thereto by welding. The fixing leg 69 passes in the vicinity of the free end of the connecting number 51*e* into a connecting leg 71 of the same width an angled at right angles to its plane. It can be directed away from the fastening side of the connecting member 51*e* or towards the top side 38*e*. According to FIG. 11 it can also be angled to the opposite side of the fastening member 51*e* or towards the underside 44*e*. The leg 71 can also abut with the end flank of the member 51*e* for multiple orientation.

In the vicinity of its free end the connecting leg 71 passes via a further bend directed away from the device base 19*e* or the connecting side 50*e* into at least one connecting member 72 positioned freely on the outside of the base 19*e*. It is advantageously formed by a flat plugging tongue and is located in a plane, which is transverse or at right angles to that of the connecting member 51*e*.

According to FIGS. 9 and 11 two roughly parallel connecting members 72 are adjacent to one another transversely to their planes with a slightly larger spacing than their thickness. The connecting members 72 according to FIG. 9 project against the plane of the underside 44*e* and according to FIG. 11 against the plane of the top side 38*e*, According to FIG. 10 the connecting body 70 only has one connecting member 72, which is in a plane roughly parallel to the connecting side 50*e*, According to FIGS. 9 and 11 the connecting members 72 are roughly parallel to the connection side 50*e*. Through the connecting members 70, which are constructed in one piece throughout, the plugging direction can be defined for the connection of the mating plugs of the device lines at right angles to the plugging direction of the connecting members 49*e*, 51*e*, 53*e*, whose plugging direction is at right angles to the connecting side 50*e*. The connecting body 70 is also spaced from and between the planes of the top 38*e* and the underside 44*e*.

FIGS. 12 to 15 show a particularly advantageous construction because here, using simple components, it is possible to use a device 1*f*, which only requires a few modifications compared with that of DE-OS 39 13 289, to which reference should be made for incorporation of features into the present invention. For converting the device base shown therein into the device base 19*f* the tools only have to be modified in such a way that the extension 21*f* is attached and on the longitudinal side 38*f* and underside 44*f* receptacles are provided for the connecting elements 23*f*. Whereas according to FIG. 1 the inner rod 15 is tensile stressed, in FIG. 12 it can be compressively stressed, so that it is much easier to obtain a thermal compensation of the switching characteristics as a function of the heating state of the device if or the device head 2*f*.

The circuit breaker 24*f* is further removed from the end face 31*f* than the additional switch 25*f*. The mounting support 22*f* for the temperature sensor 3*f* is admittedly formed by a plug connection 42*f*, but is braced with respect to the base 2*f* with the fastening members 56*f* parallel to the sensor 3*f*. The plugging member of the temperature sensor 3*f* formed by a U-shaped clip and a plate connecting its legs simultaneously forms the only connection of the device head 2*f* to the heating device 4*f*. The plate roughly parallel to the face 31*f* and flush therein forms a leg or side of a holder 73 bent in two-sided manner and whose other leg 74 is fixed in clearance-free manner, e.g, with welding spots of the bottom of the support dish 8*f*. The plate leg parallel to and spaced from the dish jacket 12*f* is braced against the device base 19*f* by the fastening members 56*f* and which are formed by the legs of the clip. The fastening menders 56*f* can be displaced in the plane 37 of the temperature sensor 3*f* and/or with respect thereto towards the underside 44*f*, so that e.g. four fastening members 56*f* are provided in the corners or angles of an imaginary rectangle. In the operating position the heads 58*f* of the fastening members 56*f* are located in the gap between the face 31*f* and the outer circumference of the dish jacket 12*f* and with a limited distance from the latter. As a revolt of the sheet metal, resiliently movable holder 73 the device head 2*f* with the temperature sensor 3*f* can in self-restoring manner perform the said movements relative to the heating device 4*f*.

The connecting piece 20*f* integrated in clearance-free manner with the device head 2*f* is completely and spaced outside the heating device 4*f*, extends at the most up to the end face 31*f* and is spaced from the base side remote therefrom. It is formed by a hard ceramic or similar extension 21*f* projecting transversely to the axial plane 40*f* on one side of the base 19*f* and which is constructed in one piece with the latter or with the base portion 32*f* and forms the base portion 30*f*. The base portion 32*f* receives the control parts and defines the width of the device base 19*f* at right angles to the axial plane 40*f* and which is several times greater than the widening by the base portion 30*f*. The extension 21*f* can extend approximately from the top side 38*f* to the underside 44*f* and is bounded on the front side by an approximately planar continuation of tile end face 31*f*.

The device 1*f* is provided here for controlling a single heating circuit, so that only two connecting elements 23*f* are required. The extension 21*f* receives a connecting element 23*f* with associated connecting member 49*f* in a substantially complete manner. The other connecting element 23*f* engages both in the base portion 32*f* and in the base portion 30*f* and is controlled by the circuit breaker 24*f* in such a way that it is conductively connected with its fixed support for the movable snap-action contact. The connecting element 23*f* connected in directly conductive manner with the connecting member 49*f* is inserted in a groove-like depression 47*f* in the top side 38*f* by a multiple of its sheet metal thickness and the connecting member 49*f* is inserted in flush manner in a depression in the underside 44*f* remote therefrom. In a view of the heating plane 10*f*, the connecting element 23*f* is at an acute angle to the connecting member 49*f* as well as to the control member 3*f*, so that these components cover one another with their inner ends, but as separate components are kept separate from one another by the insulating material of the extension 21*f*. The connecting conductor 42*f* for these components is in this case a further separate component, e.g. a rivet, which passes through an opening in the material of the extension 21*f*, which tensions both components 23*f*, 49*f* against remote sides of the extension 21*f* and also produces the line connection between the components 23*f*, 49*f*.

The controlled connecting element 23f is located in a corresponding depression flush in the underside 44f and its inner end in a view of the top side 38f coincides with a support plate 48f of the contact support, so that these two areas, as described relative to the connecting conductor 52f, are fixed in clearance-free manner with a separate connecting conductor 46f and can be conductively interconnected.

At right angles to the top side 38f, the two connecting elements 23f are at a limited distance from one another on remote sides of the device base 19f, the connecting plane 39f constituting a median plane between the planes of the two connecting elements 23f. The controlled connecting element 23f closer to the underside 44f is appropriately roughly in the plane of the connecting members 49f, 51f, 55f and with respect to which the plane of the uncontrolled connecting element 23f has a spacing which is significantly smaller than the height of the base body 19f or half or quarter thereof. In a view of the top side 38f, the two strip-like connecting elements 23f are inclined to the axial plane 40f or the end face 31f and roughly parallel to one another, the two connecting conductors 46f, 52f or the connecting member 49f being provided roughly in a common median or axial plane at right angles to the temperature sensor 3f.

The connecting areas formed by the free ends of the connecting elements 23f are at a limited distance upstream of the plane of the end face 31f. The controlled connecting element 23f passes out of the end face 31f and is inwardly displaced immediately adjacent thereto and with respect to the plane of the end face of the extension 21f. The uncontrolled connecting element 23f passes out of an inclined face 36f, which is connected at an obtuse angle to the face 31f and the end face of the extension 21f, from which the connecting member 49f passes out roughly at right angles. With respect to the plane of said end face the uncontrolled connecting area is displaced outwards, but does not project any further than the connecting member 49f.

In a view of the top side 38f the spacing between the two connecting elements 23f is approximately the same as the strip width thereof, so that there is a very small spacing between their connecting areas. The spacing of the two connecting areas from the plane of the end face 31f is roughly the same and the spacing from the outer circumference of the heating device 4f is roughly the same as the width thereof. As the face 31f and the inclined face 36f bound with said outer circumference a gap, the connecting areas are accessible from the top 38f, the underside 44f and the end face of the extension 21f, in order to connect them to connecting parts of the heating resistor 13f.

The connecting members 49f, 51f are freely accessible from these sides in order to connect the device lines. The connecting member 49f projects further roughly by the length of the extension 21f as compared with the connecting member 51f, which is positioned in protected manner in the reentrant angle between the extension 21f and the rear face of the base 19f with a limited spacing from the extension 21f and does not project any further than the latter. The connecting member 51f, like the remaining connecting members 49f, 55f, is inserted flush in the underside 44f and is conductively connected and fixed by means of a connecting conductor of the described type to the fixed contact of the switch 24f. Two to all the connecting members 49f, 51f, 55f are located in a common plane, spaced between the planes of the faces 31f of the base 19f and in a parallel connecting or plugging direction, optionally for a collective plug.

For the formation of the connecting areas the free end of the connecting element 23f can be angled towards the top side 48f, so that at least one end leg projecting transversely to the top 38f is formed. If there are two juxtaposed end legs and/or such legs at an angle to one another, then between them can be formed a reception prism, in which can be inserted the connecting part 41f both parallel to its longitudinal direction and transversely to the heating plane 10f or in stop-limited manner in the plugging direction 43f in such a way that it is then centred against transverse movements roughly parallel to the heating plane 10f. By a welded joint or the like the connecting part 41f can then be conductively fixed relative to the connecting area, particularly to its exposed strip portion roughly parallel to the heating plane 10f. The connecting element and the particular connecting member are located in the working position spaced both with respect to the heating plane 10f and set back with respect to the plane of the underside of the heating device 4f.

FIG. 12 shows two possibilities for the construction of the connection between a connecting part of the heating resistor 13f and a connecting element 23f, both or all the connections being identically constructable. The end portion of the heating resistor 13f is stiffened e.g. by a connecting piece 75 by winding in closely juxtaposed turns around a leg 76 of the connecting piece 75 projecting roughly parallel to the heating plane 10. Between said legs 76 and a leg 77 projecting freely or transversely to the heating plane 10 the connecting piece 75 forms an approximately U-shaped clip 78, whose one leg is formed by the leg 77 and whose other leg is formed by the leg 76 and is bent outwards. By means of the clip 78 the connecting piece 75 can be so anchored in positionally fixed manner in the insulating bottom 11f by pressing in or the like, that the legs 76, 77 are substantially free.

The connecting part 41f can now be constructed in one piece at least with the connecting heating portion of the heating resistor 13f or its closely juxtaposed turns or can be an end portion of the associated resistor wire. The end of the closely juxtaposed turns can pass to the leg 77, can be fixed with respect thereto by one or more turns and can then be guided up to the outer circumference of the heating device 4f up to the connecting area of the connecting element 23f, as well as being connectable thereto without any further intermediate members. It is conceivable to do away with the connecting piece 75 and to only fix the outwardly passed end portion of the resistor wire or the connecting part 41f directly with respect to the insulator 6f. The connecting part 41f can be pressed or lowered in substantially clearance-free manner into the insulating bottom 11f and/or the insulating edge 9f and consequently is enveloped by an .insulation, which secures it in position in contact-free manner relative to the dish jacket 12f.

For example the insulating edge 9f can be placed as a separate component on the substantially through, planar top of the insulating bottom, so that then the connecting part 41f is fixed between the ring-like, lower face of the insulating edge 9f and the top of the insulating bottom 11f. For the passage of the connecting part 41f, the dish jacket 12f has a passage opening, which is much wider than the connecting part 41f, which is centred in positionally fixed manner with respect to said opening by the insulator 6f, so that the latter directly forms the passage insulation and no separate insulator is required.

To avoid axial and/or rotary relative movements between the insulator 6f and the electrically conductive support dish 8f, said two components are positively fixed against one another by means of securing members 79, which can e.g. be sheet metal tongues cut free from the jacket 12f and which, following the insertion of the insulator 6f, accompanied by bending, are so pressed into the outer circumference of insulator 6f that they form depressions, in which they positively engage. Several securing members 79 are distributed over the entire circumference.

The second connecting part 41f according to FIG. 12 is formed by a separate, linear wire rod, whose cross-sections are smaller than the also wire-bent connecting piece 75 and larger than those of the heating resistor 13f. This separate connecting part 41f is fixed tangentially to the circumference of the leg 77 directly adjacent to the top of the insulating bottom 11f, traverses the insulating edge 9f and the dish jacket 12f and is connected by its outer end to the associated connecting element 23f. The connecting part 41f is also positionally secured in the described manner relative to insulator 6f. Whilst obviating a connecting piece 75, the connecting part 41 can also be directly connected to the heating resistor 13f and for this purpose a bent leg is formed, which has the functions described relative to the leg 76.

Corresponding parts are given the same reference numerals in all the drawings, but are followed by different letter references, so that all description parts apply to all the embodiments. There can be several connecting pieces or extensions and/or temperature sensors on the same device plug or separate plugs or devices 1, so that the individual features can be realized independently of one another on corresponding, separate components. All the features of the constructions according to FIGS. 1 to 11 can also be realized in the embodiment according to FIGS. 12 to 15.

We claim:

1. A control device (1, 1f) for controlling a power unit (4, 4f) having an outer circumferential boundary of an operating area defined by at least one power consumer (13, 13f), and having at least one connecting part (41, 41f) for power connection with said control device (1, 1f) when said control device (1, 1f) is operationally assembled with the power unit (4, 4f), said control device comprising:

a device base (19, 19f) for operational assembly to said power unit (4, 4f), said device base (19, 19f) having outer enveloping base faces including at least one external end face (31, 31f) located closest to the operating area when said device base (19, 19f) is in an operating position;

at least one conductive connecting element (23, 23f) for direct power connection with the at least one connecting part (41, 41f) of the power consumer (13, 13f), said direct power connection leading from said device base (19, 19f) directly into the power unit (4, 4f); and wherein said connecting element (23, 23f) is accessible in the vicinity of one of said external end faces (31, 31f) for establishing said direct power connection when said device (1, 1f) is in the operating position.

2. The device according to claim 1, wherein at least one control member (3, 24, 25 or 3f, 24f, 25f) is provided, said device base (19, 19f) carrying said control member (3, 24, 25 or 3f, 24f, 25f).

3. The device according to claim 1, wherein a supply head (20, 20f) is provided for electrically connecting the at least one power consumer (13, 13f) to an appliance line, said device base (19, 19f) forming a preassembled unit with said supply head (20, 20f), said device base (19, 19f) forming a portion of said supply head (20, 20f), said connecting element (23, 23f) projecting substantially freely to provide an arm offset with respect to said device base (19, 19f).

4. The device according to claim 1, wherein at least one connecting member is provided for connecting said device base (19, 19f) to an appliance line, at least one of said connecting elements (23, 23f) and at least one of said connecting members (49, 49f) being electrically connected without intervening circuit breakers within said device base (19, 19f).

5. The device according to claim 1, wherein said device base (19, 19f) defines at least one connecting plane (39, 39f), at least one connecting member (49, 49f) being provided, said connecting element (23, 23f) and said connecting member (49, 49f) being reciprocally displaced transverse to said connecting plane (39, 39f), at least one connecting conductor (52, 52f) being provided, said connecting element (23, 23f) and said connecting member (49, 49f) being conductively interconnected by at least one connecting conductor (52, 52f) oriented transverse to said connecting plane (39, 39f), said connecting element and said connecting member being inserted into said device base (19, 19f) in substantially transverse and opposite directions.

6. The device according to claim 1, wherein said outer enveloping base faces include a first face (31, 31f) and at least one second face substantially remote from said first face, said connecting element (23, 23f) being located closer to said first face (31, 31f) of said device base (19, 19f) than to said second face.

7. The device according to claim 1, wherein said outer enveloping base faces include a first face (31, 31f) and second face remote from said first face (31, 31f), said connecting element (23, 23f) projecting up to and beyond said first face (31, 31f) of said device base (19, 19f).

8. The device according to claim 1, wherein a plurality of connecting elements (23, 23f) are provided, and wherein a control connecting plane (39, 39f) is defined as a median plane between planes defined by two of said connecting elements (23, 23f).

9. The device according to claim 1, wherein at least two of said connecting elements (23, 23f) extend over at least one of said outer enveloping faces (31, 31f, 36f) of said device base (19, 19f).

10. The device according to claim 1, wherein said device base (19, 19f) has at least one first side and at least one second side substantially remote from said first side, wherein said control device (1, 1f) defines at least one connecting plane (39, 39f), wherein a plurality of connecting elements (23, 23f) are provided, said connecting elements (23, 23f) being oriented substantially parallel to one another and of elongated shape, said connecting elements (23, 23f) being inserted into said device base (19, 19f) on opposite sides of said connecting plane (39, 39f), and at least one of said outer enveloping base faces (31, 31f) of said device base (19, 19f) being located between two of said connecting elements (23, 23f) without further connectors being interposed between said connecting elements (23, 23f).

11. The device according to claim 1, wherein at least one connecting element and at least one connecting member for at least one appliance line is provided, at least one connecting plane being defined, said connecting element (23, 23*f*) and said connecting member (49, 51, 53, 55 or 49*f*, 51*f*, 55*f*) being oriented substantially parallel to said connecting plane (39, 39*f*), said connecting member (49, 51, 53, 55 or 49*f*, 51*f*, 55*f*) being located in the vicinity of at least one of said outer enveloping base faces of said device base (19, 19*f*), at least one of said outer enveloping base faces being oriented transverse to said end face (31, 31*f*).

12. The device according to claim 1, wherein at least one connecting member (49, 51, 53, 55 or 49*f*, 51*f*, 55*f*) is provided for connecting said device base (19, 19*f*) to at least one appliance line, said connecting element (23, 23*f*) being oriented at an angle to said connecting member (49, 51, 53, 55 or 49*f*, 51*f*, 55*f*).

13. The device according to claim 1, wherein at least one control member (3, 3*f*) defining at least one control axis is provided, wherein said device base (19, 19*f*) has remote sides, at least one connecting plane being defined by said device base (19, 19*f*), said device base (19, 19*f*) bearing upon at least one control member (3, 3*f*) projecting beyond said outer enveloping base faces (31, 31*f*), said control member (3, 3*f*) and said connecting elements (23, 23*f*) being located together substantially in the vicinity of one of said outer enveloping base faces (31, 31*f*), said control member (3, 3*f*) and said connecting element (23, 23*f*) being located at an acute angle to one another, said connecting element (23, 23*f*) and said control member (3, 3*f*) being located on said device base (19, 19*f*) and being inserted from at least one of said remote sides.

14. The device according to claim 1, wherein at least one connecting plane (39*f*) is defined, and wherein at least one of said connecting element (23*f*) is elongated in a direction not at right angles with respect to said end face (31*f*) of said device base (19*f*).

15. The device according to claim 1, wherein at least one connecting plane (39*f*) is defined, said device base (19, 19*f*) providing at least one external corner zone (36*f*) connecting to two substantially perpendicular ones of said outsides, in said connecting plane (39*f*) at least one of said connecting elements (23, 23*f*) being located in the vicinity of said corner zone (36*f*), said corner zone (36*f*) being provided by an intermediate face (36*f*) connected to at least one of said substantially perpendicular outsides (31*f*) other than by a right angle connection.

16. The device according to claim 1, wherein in the operating position at least one said connecting elements (23, 23*f*) and at least one of said end faces (31, 31*f*) are each spaced from the outside of the power unit (4*f*).

17. The device according to claim 1, wherein at least one of said device bases (19, 19*f*) provides at least two substantially successive base portions (30, 32 or 30*f*, 32*f*), at least one of said base portions providing at least one marginal base extension, at least one of said base portions providing at least one supply head (20) for power supply of the power unit (4, 4*f*), in the operating position at least one of the base portions engaging the power unit (4, 4*f*).

18. The device according to claim 17, wherein the power unit (4, 4*f*) has at least one connecting part (41, 41*f*), at least one of said base portions (30, 73) defining at least one engagement side (31, 31*f*) associated with the power unit in the operation position, at least one of said connecting elements (23, 23*b*, 23*c*, 23*d*, 23*e*) being accessible, in the vicinity of said engagement side (31), for electrical connection of said connecting part (41, 41*f*) to the power unit (4), said supply head (20, 20*f*) and substantially a remainder of said device base (19, 19*f*) providing two said base portions made from electrically insulating material.

19. The device according to claim 17 wherein at least one of said supply heads (20, 20*f*) has at least one engagement side (31, 31*f*) facing the power unit (4, 4*f*), at least one control member (3, 3*f*) projecting transversely and freely from said engagement side (31, 31*f*).

20. The device according to claim 1, wherein said power unit (4, 4*f*) provides a heating plane (10, 10*f*), said device base (19, 19*f*) having a top side (38, 38*f*) facing in a common direction with the heating plane (10, 10*f*), at least one detector (3, 3*f*) being provided, said connecting element (23, 23*f*) providing at least one connecting lug projecting over said device base (19, 19*f*) and being displaceable in at least one of three directions relative to said device base (19, 19*f*), said top side (38, 38*f*) of said device (1, 1*f*) providing a base portion (30, 32 or 30*f*, 32*f*) of said device base (19, 19*f*), in view of said top side (38, 38*f*), a plurality of said connecting elements (23, 23*f*) being juxtaposed and bendingly displaceable transversely to said top side (38, 38*f*) with respect to said device base (19, 19*f*).

21. The device according to claim 1, wherein elongated connecting conductors (46, 52 or 46*f*, 52*f*) are provided for connecting said connecting elements (23, 23*f*) to said connecting members (49, 51, 53, 72 or 49*f*, 51*f*), said connecting conductor (46, 52 or 46*f*, 52*f*) being located within said device base (19, 19*f*), said connecting members (49, 51, 53 or 49*f*, 51*f*) being spaced from said end face (31, 31*f*) and located at an outer connecting side (50, 50*f*) positioned transverse to said end face, said connecting members being accessible for connection with at least one of the device lines, each of said connecting conductors (46, 52) being constructed in one piece from deformed sheet metal with at least one of said connecting elements (23) and with at least one of said connecting members (49, 51, 53).

22. The device according to claim 1, wherein said device base (19, 19*f*) provides a first base portion and a second base portion, at least one connecting part (41, 41*f*) and at least one connecting element (23, 23*f*) being provided, at least one of said connecting parts (41, 41*f*) and at least one of said connecting elements (23, 23*f*) being interconnected by connecting conductors (46, 52 or 46*f*, 52*f*), at least one of said connecting elements (23, 23*f*) being substantially counter-sunk in at least one of said base portions (30, 32, 30*f*, 32*f*) of said device base (19, 19*f*), with connecting conductors (46, 52 46*f*, 52*f*) being provided in said base section and being located in a closely adapted opening (47, 47*f*) traversing at one of said base portions (30, 32 or 30*f*, 32*f*).

23. The device according to claim 1, wherein at least one connecting member (49, 51, 53, 72, 49*f*, 51*f*) and at least one connecting conductor (46, 52, 46*f*, 52*f*) are provided, and at least one connecting plane (39, 39*f*) is defined, at least one of said connecting elements (23, 23*f*) together with at least one of said connecting conductors (46, 52, 46*f*, 52*f*) and at least one of said connecting members (49, 51, 53, 49*f*, 51*f*) providing a bend through said element, said conductor and said connecting member with respect to said connecting plane (39, 39*f*).

24. The device according to claim 1, wherein a switch (24, 25*f*) is carried by said device base, said switch (24, 25*f*) having a fixed contact, said switch (24, 25*f*) defining a switch plane, said device base providing successive base portions, at least one connecting member (49, 51, 53, 49*f*, 51*f*) and at least one connecting conductor (46, 52, 46*f*, 52*f*) being provided, at least one detector (3, 3*f*) being provided and defining at least one axial detector plane (40, 40*f*), at least one connecting plane (39, 39*f*) being defined, at least one of said connecting elements (23, 23*f*) being connected via at least one of said connecting conductor (46, 46*f*) to said fixed contact of said switch (24, 24*f*), said connecting element (23, 23*f*), said connecting conductor (46, 52, 46*f*, 52*f*) and said connecting member (49, 51, 53, 49*f*, 51*f*) being arranged on one side of said detector plane (40, 40*f*) and oriented transverse to said connecting plane (39, 39*f*) and fixed to said base portions (30, 32, 30*f*, 32*f*), all of said connecting conductors (46, 52, 46*f*, 52*f*) being provided substantially on one side of said switch plane oriented transverse to said detector (3, 3*f*) and defined by said switch (24, 25*f*) closest to said end face (31, 31*f*).

25. The device according to claim 1, wherein said device base provides at least two successive base portions, at least one fastening extension being provided for fixing to at least one of said base portions (30, 32, 30*f*, 32*f*), at least one of aid connecting elements (23, 23*f*), at least one connecting member (49, 41, 53, 55, 49*f*, 51*f*, 55*f*) , at least one base body of a switch (24, 25 or 24*f*, 25*f*) and at least one mounting support (22, 22*f*) for a sensor (3, 3*f*) providing a one-part component with said fastening extension, said fastening extension engaging in a reception opening of at least one of said base portions (30, 32, 30*f*, 32*f*), said fastening extension providing a deformable body, an interlocking member (67, 67*f*) and a claw plug.

26. The device according to claim 1, wherein at least one connecting member (72) is provided for conductively receiving at least one external supply line, said connecting member (72) being located on a connecting side (50*e*) of said device base (19*e*), said connecting member (72) of said device base (19*e*) being formed by at least one leg of a one multiple bend connecting body (70) having a leg separate from said connecting member (72) and conductively fixed with said fastening leg (69), at least one flat tongue (49*e*, 51*e*, 53*e*) being provided and projecting over one of said connecting side (50*e*) of said device base (19*e*), said flat tongue having at least one flat side fixedly and substantially coplanarly receiving said fastening leg (69), said fastening leg being a plate structure emanating from a bend.

27. The device according to claim 1, wherein said control device (1, 1*f*) is an assembly including said power unit (4, 4*f*), said power unit (4, 4*f*) having a support body defining an external body circumference, at least one fastening member being provided and connecting said device base (19, 19*f*) to said power unit (4, 4*f*), said device base (19, 19*f*) being located at a distance outside said body circumference of said support body (5, 5*f*), said end face (31, 31*f*) being separated by a narrow assembly gap from a fastening member (56*f*).

28. The device according to claim 27, wherein said support body of said power unit has at least one base body (8) made from pressure-resistant material, said base body (8) being constructed in one piece with said fastening member (56) providing a securely interlocking member for at least one base portion (30, 32) of said device base (19, 19*f*).

29. The device according to claim 1, including at least one heating resistor (13, 13*f*) on said power unit (4, 4*f*), said heating resistor (13, 13*f*) having at least connecting section (41, 41*f*) providing at least one connecting face, wherein at said connecting element (23, 23*f*) is provided for direct connection to the connecting section (41, 41*f*) free of any intermediate member, the connecting section (41, 41*f*) being constructed in one piece with substantially a remainder of said heating resistor (13, 13*f*), said connecting element (23, 23*f*) having at least one connecting face, and said connecting face being substantially planar.

30. The device according to claim 1, including at least one support body (5) on said power unit (4), wherein at least one casing cover (59) is provided for at least, partially covering said device base (19, 19*f*), and a casing cover (59) being secured with respect to said device base (19, 19*f*) by engagement with the power unit (4), said casing cover (59) at least partly providing a thin leaf spring engaging at least one slot (62) of the power unit (4), said casing cover (59) and at least one base portion (30, 32) of said device base (19) being secured with respect to said support body (5) by at least one snap connection (61).

* * * * *

UNITED STATES PATENT AND TRADEMARK OFFICE

CERTIFICATE OF CORRECTION

PATENT NO. : 5,420,398

DATED : May 30, 1995

INVENTOR(S) : Heinz Petri, et al.

It is certified that error appears in the above-indentified patent and that said Letters Patent is hereby corrected as shown below:

| | |
|---|---|
| Col. 1, line 7 | "hone" should be --home--. |
| Col. 1, line 36 | "fore" should be --form--. |
| Col. 4, line 54 | "seine" should be --same--. |
| Col. 7, line 36 | "red" should be --rod--. |
| Col. 8, line 17 | "ba" should be --be--. |
| Col. 9, line 12 | "redial" should be --radial--. |
| Col. 11, line 4 | "522" should be --52--. |
| Col. 11, line 18 | "remove" should be --removal--. |
| Col. 13, line 9 | "cuter" should be --outer--. |
| Col. 13, line 19 | "the" should be --two--. |
| Col. 14, line 52 | the second "in" should --μm--. |
| Col. 15, line 12 | "an" should be --and--. |
| Col. 15, line 33 | "," should be --.--. |

UNITED STATES PATENT AND TRADEMARK OFFICE

CERTIFICATE OF CORRECTION

PATENT NO. : 5,420,398
DATED : May 30, 1995
INVENTOR(S) : Heinz Petri, et al.

It is certified that error appears in the above-indentified patent and that said Letters Patent is hereby corrected as shown below:

| | |
|---|---|
| Col. 15, line 36 | "," should be --.--. |
| Col. 15, line 61 | "if" should be --lf--. |
| Col. 16, line 7 | "of" should be --to--. |
| Col. 16, line 21 | "revolt" should be --result--. |
| Col. 16, line 40 | "tile" should be --the--. |
| Col. 18, line 57 | Delete the "period" at beginning of the sentence. |
| Col. 21, line 52 | "one said" should be --one of said--. |

Signed and Sealed this

Twelfth Day of September, 1995

*Attest:*

Bruce Lehman

BRUCE LEHMAN

*Attesting Officer*

*Commissioner of Patents and Trademarks*